US006841061B1

(12) United States Patent
Ukita

(10) Patent No.: US 6,841,061 B1
(45) Date of Patent: Jan. 11, 2005

(54) ANTIGELLING AGENT FOR HYDROCARBON MIXTURE CONTAINING CONJUGATED DIENE AND METHOD OF PREVENTING CLOGGING OF APPARATUS FOR SEPARATING AND PURIFYING THE MIXTURE

(75) Inventor: Keizo Ukita, Okayama (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 09/926,302

(22) PCT Filed: Apr. 7, 2000

(86) PCT No.: PCT/JP00/02285

§ 371 (c)(1),
(2), (4) Date: Oct. 9, 2001

(87) PCT Pub. No.: WO00/61701

PCT Pub. Date: Oct. 19, 2000

(30) Foreign Application Priority Data

Apr. 8, 1999 (JP) ..... 11/100814

(51) Int. Cl.[7] ..... C10G 7/00; C09K 15/00

(52) U.S. Cl. ..... 208/48 R; 208/48 AA; 208/92; 208/184; 585/3; 585/4; 585/5; 252/397; 252/400.2; 252/405; 252/401; 252/407

(58) Field of Search ..... 208/48 R, 48 AA, 208/92, 184; 585/3, 4, 5; 252/397, 400.2, 405, 401, 407

(56) References Cited

U.S. PATENT DOCUMENTS 4,292,414 A * 9/1981 Saito et al. ..... 525/255
6,579,442 B2 * 6/2003 Eldin ..... 208/48 AA

FOREIGN PATENT DOCUMENTS

| | | |
|---|---|---|
| DE | 2 166 126 A1 | 4/1973 |
| EP | 0 061 059 A1 | 12/2000 |
| JP | 10-251662 A | 9/1998 |
| JP | 10-251663 A | 9/1998 |
| WO | WO 99/44972 | 9/1999 |

* cited by examiner

*Primary Examiner*—Walter D. Griffin
*Assistant Examiner*—James Arnold, Jr.
(74) *Attorney, Agent, or Firm*—Armstrong, Kratz, Quintos, Hanson & Brooks, LLP

(57) ABSTRACT

An Anti-gelling agent for a hydrocarbon mixture containing a conjugated diene, which comprises (a) at least one compound selected from the group consisting of compounds having an NO radical in the molecule, and precursor compounds capable of forming an NO radical, (b) a phosphorus-containing compound, and (c) at least one compound selected from the group consisting of heterocyclic aldehydes, aromatic aldehydes and condensates of these aldehydes. Clogging in an apparatus for separating and refining a hydrocarbon mixture containing a conjugated diene can be prevented by adding the anti-gelling agent in the apparatus.

21 Claims, 3 Drawing Sheets

ANTIGELLING AGENT FOR HYDROCARBON MIXTURE CONTAINING CONJUGATED DIENE AND METHOD OF PREVENTING CLOGGING OF APPARATUS FOR SEPARATING AND PURIFYING THE MIXTURE

TECHNICAL FIELD

This invention relates to a method of preventing clogging of an apparatus for separating and refining a hydrocarbon mixture containing a conjugated diene, and an anti-gelling agent for the hydrocarbon mixture. More specifically, it relates to an anti-gelling agent used for preventing clogging and a method of preventing clogging in an apparatus, which are used for separating and refining unsaturated hydrocarbons such as ethylene, propylene, butene, butadiene or isoprene from a hydrocarbon mixture containing hydrocarbon compounds having at least two carbon atoms which mixture is produced by removing, for example, methane, hydrogen and nitrogen from a cracker gas of a thermal cracker or a refinery gas from a refinery, wherein clogging of a distillation column, a reboiler or a piping is prevented and the reduction of heat efficiency is minimized.

BACKGROUND ART

Conjugated dienes such as butadiene and isoprene tend to be polymerized alone or copolymerized with other copolymerizable unsaturated compound at a step of distillation, extractive distillation, extraction, hydrogen-treatment, hydrogenation purification or heat treatment, or during storage, transportation or processing.

Conjugated dienes are contained, for example, in a C4 hydrocarbon fraction, a C5 hydrocarbon fraction, a hydrocarbon mixture containing hydrocarbon compounds having at least two carbon atoms, such as that produced by removing mathane, hydrogen and nitrogen from a cracker gas from a thermal cracker or a refinery gas from a refinery, a hydrocarbon mixture containing hydrocarbon compounds having at least three carbon atoms, such as that produced by separating and refining ethylene for example, by low-temperature fractional distillation, and a hydrocarbon mixture containing hydrocarbon compounds having at least six carbon atoms, such as that produced by removing a C4 hydrocarbon fraction and a C5 hydrocarbon fraction. In an apparatus for separating and refining these hydrocarbon fractions and hydrocarbon mixtures, a column or tank, a piping, a heat exchanger and the like of the apparatus are liable to be clogged with a polymer deposited thereon. The polymer is believed to be produced by polymerization or copolymerization of the conjugated dienes. Therefore, operation of the apparatus must be regularly or irregularly stopped for cleaning the inside thereof to remove the deposited polymer.

Thus, it is desired to prevent polymerization of conjugated dienes and to minimize clogging of a deposited polymer in an apparatus of separating and refining a hydrocarbon mixture containing conjugated dienes. As the method of preventing polymerization of conjugated dienes, there have bee proposed, for example, a method of distilling a C5 hydrocarbon fraction in the presence of a di-lower-alkylhydroxylamine in Japanese Unexamined Patent Publication (hereinafter abbreviated to "JP-A") No. S50-112304, a method of effecting an extractive distillation while furfural and a condensate of furfural are made present in an extraction medium in JP-A S56-81526 or Japanese Examined Patent Publication (hereinafter abbreviated to "JP-B") No. S43-20281, a method of extractive distilling a conjugated diene hydrocarbon while a polymerization inhibitor or a chain transfer agent is made present in an extraction medium in JP-B S47-41323 or JP-B S45-19682, and a method of prohibiting polymerization of a conjugated diene hydrocarbon by incorporating therein an organic phosphate ester compound in JP-B S49-6886 or JP-S49-7126.

According to the heretofore proposed polymerization-preventing methods and polymerisation inhibitors, even though the polymerization inhibitor is incorporated in a sufficient amount, the problem of clogging in a separating and refining apparatus, especially in a vessel wherein a hydrocarbon mixture is exposed to a high temperature, such as an evaporator or a distillation column, cannot completely be solved.

DISCLOSURE OF THE INVENTION

An object of the present invention is to provide an anti-galling agent for preventing clogging and a method of preventing clogging in a separating and refining apparatus for a hydrocarbon mixture, whereby formation of gel at a high temperature is reduced, staining within the apparatus and clogging of piping and other vessels are avoided, and reduction of heat efficiency in minimized over a long period of time by incorporating a minor amount of the anti-gelling agent.

To achieve the above-mentioned object, the present inventor made extensive researches and found it important to prevent not only polymerization of a conjugated diene but also gelling of a polymer to completely solve the problem of clogging in piping and other vessels. The present inventor further found that the above-mentioned object can be achieved by feeding an anti-gelling agent containing a compound having an NO radical in the molecule or a precursor compound capable of forming an NO radical, a phosphorus-containing compound, and furfural or its condensate, into an apparatus for separating and refining a hydrocarbon mixture.

Thus, in accordance with the present invention, there is provided an anti-gelling agent for a hydrocarbon mixture containing a conjugated diene, which comprises (a) at least one compound selected from the group consisting of compounds having an NO radical in the molecule, and precursor compounds capable of forming an NO radical, (b) a phosphorus-containing compound, and (c) at least one compound selected from the group consisting of heterocyclic aldehydes, aromatic aldehydes and condensates of these aldehydes.

In accordance with the present invention, there is further provided a method of preventing clogging in an apparatus of separating and refining a hydrocarbon mixture containing a conjugated diene, which comprises adding into the apparatus (a) at least one compound selected from the group consisting of compounds having an NO radical in the molecule, and precursor compounds capable of forming an NO radical, (b) a phosphorus-containing compound, and (c) at least one compound selected from the group consisting of heterocyclic aldehydes, aromatic aldehydes and condensates of these aldehydes,

BEST MODE FOR CARRYING OUT THE INVENTION

Figure 1:
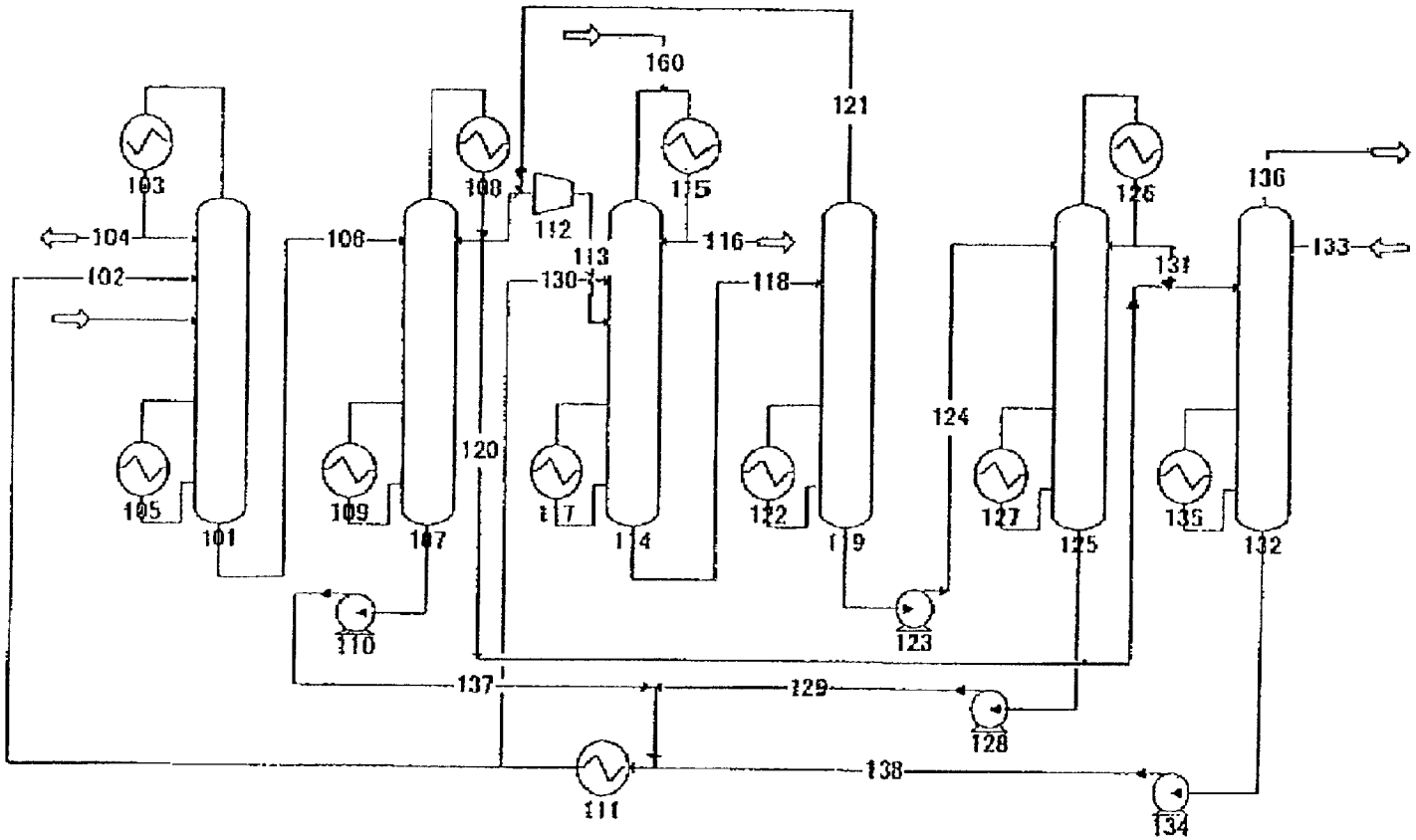
FIG. 1 is a schematic diagram of an apparatus for separating and refining a C4 fraction from a hydrocarbon mixture.

The anti-galling agent of the present invention comprises (a) at least one compound selected from the group consisting of compounds having an NO radical in the molecule, and precursor compounds capable of forming an NO radical, (b) a phosphorus-containing compound, and (c) at least one compound selected from the group consisting of heterocyclic aldehydes, aromatic aldehydes and condensates of these aldehydes,

Compound (a)

Compound (a) is at least one compound selected from compounds having an NO radical in the molecule, and precursor compounds capable of forming an NO radical, and it includes inorganic compounds and organic compounds. As examples of such compounds, the following compounds (1) to (7) can be mentioned.

(1) N,N-dialkylhydroxylamines Represented by the Formula (I):

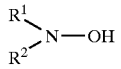

(I)

wherein $R^1$ and $R^2$ independently represents a straight chain, branched or cyclic alkyl group having 1 to 10 carbon atoms.

The alkyl group preferably has 1 to 6 carbon atoms. As specific examples of the alkyl group, there can be mentioned methyl, ethyl, propyl, isopropyl, butyl, pentyl and cyclohexyl groups. As a preferable specific example of the N,N-dialkylhydroxylamine, there can be mentioned N,N-diethylhydroxylamine (DEHA).

(2) Nitroxyl Compounds of a Steric Hindered Amine as Described in JP-B S60-237065 (a Compound Having an NO Radical in the Molecule)

The nitroxyl compounds (also called as N-oxyl or nitroxide is a free radical having an unpaired electron, represented by the following formula (II):

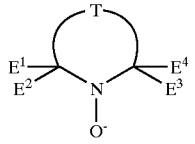

(II)

wherein the nitrogen atom is bonded directly with two carbon atoms having four substituents, each of $E^1$, $E^2$, $E^3$ and $E^4$ independently represents an organic group, and T represents an organic group needed for forming a five-membered or six-membered ring.

A preferable example of $E^1$, $E^2$, $E^3$ and $E^4$ is a methyl group. As specific examples of the nitroxyl compound, there can be mentioned 4-hydroxy-2,2,6,6-tetramethylpiperidin-1-oxyl, 4-oxo-2,2,6,6-tetramethylpiperidin-1-oxyl, 4-benzoyloxy-2,2,6,6-tetramethylpiperidin-1-oxyl, 3-carbamoyl-2,2,5,5-tetramethylpyrrolidin-1-oxyl, N-(1-oxyl-2,2,6,6-tetramethylpiperidin-4-yl)-ξ-caprolactam, 3-oxyl-2,2,4,4-tetramethyl-7-oxa-3,20-diazaspiro[5.1.11.2]heneicosan-21-on, 4-aza-3,3-dimethyl-4-oxyl-1-oxaspiro[4.5]decane and 2,4,4-trimethyl-2-phenyloxazolidine-3-oxyl, (3) Hydroxylamine Compounds Corresponding to Nitroxyl Compounds of a Steric Hindered Amine as Described in JP-B S60-237065

The above-mentioned hydroxylamine compound is a precursor compound of capable of forming an NO radical (free radical) in situ in a system having added therein a polymerization inhibitor, and is expressed by the following formula (III):

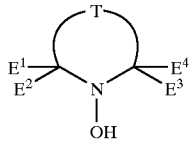

(III)

wherein the nitrogen atom is bonded directly with two carbon atoms having four substituents, each of $E^1$, $E^2$, $E^3$ and $E^4$ independently represents an organic group, and T represents an organic group needed for forming a five-membered or six-membered ring, A preferable example of $E^1$, $E^2$, $E^3$ and $E^4$ is a methyl group. As specific examples of the hydroxylamine compound, there can be mentioned 1,4-dihydroxy-2,2,6,6-tetramethylpiperidine, 4-benzoyloxy-1-hydroxy-2,2,6,6-tetramethylpiperidine, di-(1-hydroxy-2,2,6,6-tetramethylpiperidin-4-yl) sebacate and N-(1-hydroxy-2,2,6,6-tetramethylpiperidin-4-yl)-ξ-caprolactam.

(4) Nitrogen Oxides Having a Stable Free Radical and Precursors Capable of Forming a Stable Free Radical in situ, as Described in JP-B H4-26639.

The nitrogen oxides having a stable free radical (more specifically, a free radical existing for a prolonged period such that it is capable of being detected in a static system by an ordinary spectroscopic examination; half-life being usually at least one year) includes, for example, di-t-butyl nitroxide, piperidinyl-1-oxy compounds, pyrrolidin-1-oxy compounds and pyrrolin-1-oxy compound. As specific examples of the piperidinyl-1-oxy compounds, there can be mentioned 4-hydroxy-2,2,6,6-tetramethylpiperidine-1-oxy, 4-oxo-2,2,6,6-tetramethylpiperidine-1-oxy and 2,2,6,6-tetramethylpiperidine-1-oxy.

The precursors capable of forming a stable free radical in situ include, for example, nitron, nitroso, thioketone, benzoquinone and hydroxylamine. The precursors further include nitrosophenyl hydroxylamine and its ammonium salt.

(5) Reaction Products of N,N-di-lower-alkylhydroxylamine with an Organic Acid as Described in U.S. Pat. No. 3,371,124 and JP-B S41-17458

The reaction products include, for example, salts of oxalic acid with the above-mentioned N,N-dialkylhydroxylamine [e.g., bis(diethylhydroxylamine)oxalate], and salts of an oxyacid or polycarboxylic acid with N,N-di-lower-alkylhydroxylamine as described in JP-B S41-17458.

As specific examples of the lower alkyl group, there can be mentioned methyl, ethyl, propyl, isopropyl, butyl and hexyl groups. As specific examples of the organic acid, there can be mentioned oxalic acid, lactic acid, tartaric acid, citric acid, malic acid, malonic acid, sucoinio acid, glutaric acid, adipic acid, pimelic acid, sebacic acid and azelaic acid.

An specific examples of the salts of N,N-di-lower-alkylhydroxylamine, there can be mentioned diethylhydroxylammonium citric acid salt, bis(diethylhydroxylammonium)tartaric acid salt, bis(diethylhydroxylammonium)adipic acid salt and bis-dibutyl-hydroxylamine sebacic acid salt.

(6) Hindered amine compounds having an N-hydrocarbyloxy substituent as described in JP-A H4-233905; heterocyclic compounds such as phenothiazine as described in JP-A H4-233906; primary, secondary or tertiary hydroxylamine compounds; hindered amine compounds having an N-oxycarbamoyl substituent as described in JP-A H4-233907; and N—OH compounds as described in JP-A H4-288302, such as N-(1-hydroxy-2,2,6,6-tetramethylpiperidin-4-yl)caprolactam, bis(1-hydroxy-2,2,6,6-tetramethylpiperidin-4-yl)sebacate, 1-hydroxy-2,2,6,6-tetramethylpiperidin-4-yl benzoate and 1-hydroxy-2,2,6,6-tetramethylpiperidin-4-yl acryalte.

Representative examples of these compounds are those which are represented by the following formulae (IV) and (V):

(IV)

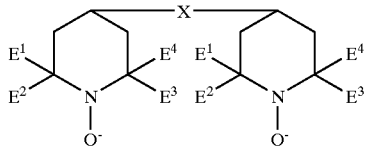

wherein the nitrogen atom is bonded directly with two carbon atoms having four substituents, each of $E^1$, $E^2$, $E^3$ and $E^4$ independently represents an organic group, and X represents a divalent connecting group.

(V)

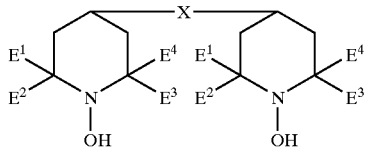

wherein the nitrogen atom is bonded directly with two carbon atoms having four substituents, each of $E^1$, $E^2$, $E^3$ and $E^4$ independently represents an organic group, and X represents a divalent connecting group.

In formulae (IV) and (V), a preferable example of $E^1$, $E^2$, $E^3$ and $E^4$ is a methyl group, and a preferable example of X is represented by the formula:

$$—COO—(CH_2)_n—COO— \quad (n=1–20)$$

As specific example of the compound having such divalent connecting group X, there can be mentioned bis(1-oxy-2,2,6,6-tetramethylpiperidin-4-yl)sebacate represented by the following formula (VI):

(VI)

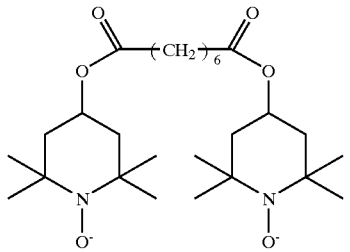

(7) Nitric Acid Salt

A nitric acid salt such as sodium nitrite ($NaNO_2$) is an inorganic compound precursor capable of forming an NO radical in situ in a system having added therein a polymerization inhibitor. Sodium nitrite is especially effective when it is used in combination with an inorganic phosphorus-containing compound, mentioned below, such as sodium dihydrogenphosphate, or a phosphate ester surface active agent or tris(nonylphenyl)phosphite.

Among the above-mentioned compounds (a), compound (1) overlaps with compound (6). Most of the above-mentioned compounds (a) are generally known as a premature polymerization inhibitor. However, the present inventor's research revealed that these compounds (a) exhibit poor polymerization inhibiting activity for many monomers including conjugated diene monomers. In the present invention, compound (a) is characterized as being used in combination with a phosphorus-containing compound (b), Phosphorus-containing Compound (b)

The phosphorus-containing compound is not particularly limited, and includes, for example, (i) a phosphoric acid compound selected from phosphoric acid, phosphonic acid, phosphinic acid, diphosphonic acid, hypophosphoric acid, diphosphoric acid, tripolyphosphoric acid and mataphosphoric acid, (ii) an ester of the phosphoric acid compound, (iii) an alkali metal salt or an ammonium salt of the phosphoric acid compound, (iv) a compound prepared by introducing an ester bond plus an alkali metal bond or an ammonium salt bond into the phosphoric acid compound, (v) a phosphine compound, and (vi) a hexaalkylphosphorus triamide. As specific examples of these phosphorus-containing compounds, there can be mentioned the following compounds.

(i) Phosphoric Acid Compound (1) Phosphoric Acid (1)

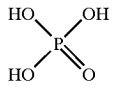

(2) Phosphonic Acid (Phosphorous Acid)

(2)

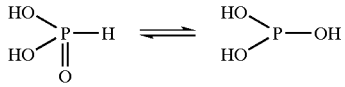

Phosphonic acid is a dibasic acid, shown in the left of formula (2), having a P—H bond, whose oxidation number is 3. Phosphonic acid is considered to have a tautomer, shown in the right of formula (2).

(3) Phosphinic Acid (Hypophosphorous Acid)

(3)

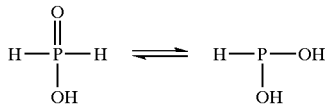

Phosphinic acid is a monobasic acid, shown in the left in formula (3), whose oxidation number is 3. Phosphinic acid is considered to have a tautomer, shown in the right in formula (3).

(4) Diphosphonic Acid (Diphosphorous Acid)

(4)

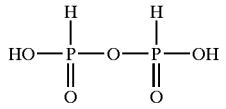

(5) Hypophosphoric Acid (5)

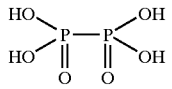

(6) Pyrophosphoric Acid (Diphosphoric Acid)

(6)

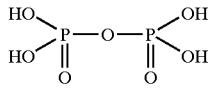

(7) Tripolyphosphoric Acid (Triphosphoric Acid)

$H_5P_3O_{10}$ (7)

(8) Metaphosphoric Acid (8)

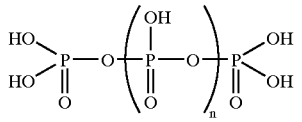

wherein n is usually in the range of 0 to 14.

(ii) Ester of Phosphoric Acid Compound (1) Alkyl Dihydrogenphosphate (9)

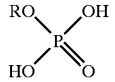

wherein R includes hydrocarbon groups such alkyl, phenyl and alkylphenyl groups, and further includes hydrophobic groups such as polyethylene oxide and alkylphenyl polyethylene oxide groups. This definition for R is the same in the following compounds.

(2) Dialkyl Hydrogenphosphate (10)

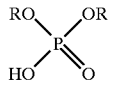

(3) Trialkyl Phosphate (11)

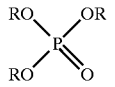

Besides the above compounds (1), (2) and (3), the ester of a phosphoric acid compound further includes, for example, phosphonic acid asters such as dimethyl phosphonate, diethyl phosphonate, triethyl phosphonate, triisopropyl phosphonate and triphenyl phosphonate, and metaphosphoric acid esters.

The phosphonic acid asters are phosphorus-containing compounds represented by the following formulae (12), (13) and (14);

$$HP(O)(OH)(OR) \quad (12)$$

$$HP(O)(OR)_2 \quad (13)$$

$$P(OR)_3 \quad (14)$$

As specific examples of the ester of a phosphoric acid compound, there can be mentioned triphenyl phosphate represented by the formula (15):

(15)

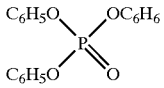

and tris(nonylphenyl)phosphite represented by the formula (16):

$$(C_9H_{10}—C_8H_4—O)_3P \quad (16)$$

The ester of a phosphoric acid compound, which has a hydrophobic group, includes various phosphoric acid ester surface active agents. Of the phosphoric acid ester surface active agents, those which are generally used as a corrosion preventive are especially preferable because they function as an inhibitor for a popcorn polymer and a rubbery polymer as well as a corrosion preventive, The phosphoric acid ester surface active agent includes, for examples an alkyl dihydrogenphosphate represented by the formulae (17):

(17)

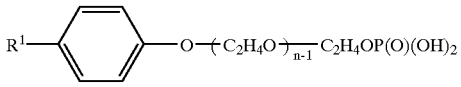

wherein $R^1$ is an alkyl group having usually 7 to 18 carbon atoms, especially 8 or 9 carbon atoms, and n is an average addition mole number of usually 1 to 18, in many cases 2 to 8, a dialkyl hydrogenphosphate represented by the formula (18):

(18)

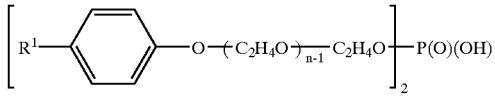

wherein $R^1$ is an alkyl group having usually 7 to 16 carbon atoms, especially 8 or 9 carbon atoms, and n is an average addition mole number of usually 1 to 18, in many cases 2 to 8, and a phosphoric acid ester represented by the formula (19):

$$[R^1—O—(C_2H_4O)_{n-1}—C_2H_4O]_m—P(O)(OH)_{3-m} \quad (19)$$

wherein $R^1$ is an alkyl group having usually 7 to 18 carbon atoms, especially 8 or 9 carbon atoms, n is an average addition mole number of usually 1 to 18, in many cases 2 to 8, and m is an integer of 1 to 3. As specific examples of the phosphoric acid ester surface active agent, there can be mentioned that which are represented by the formula (20), for example, polyoxyethylene nonyl phenyl ether phosphate (for example, "LATEMUL"™ P-909 available from Kao Corporation):

(20)

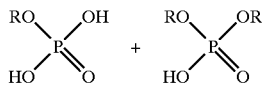

R: $C_9H_{19}$—$C_6H_4O$—O—$(C_2H_4O)_8$—$C_2H_4$— trialkyl phosphate represented by the formula (21) (for example, "PELEX"™ RP available from Kao corporation):

(21)

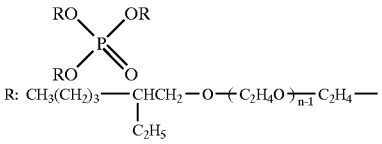

(iii) Alkali Metal Salt or Ammonium Salt of Phosphoric Acid Compound (1) Primary Phosphate Salt (22)

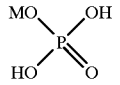

wherein M in an alkali metal such as Na or K, or an ammonium group. This definition for M is the same in the following formulae (23), (24) and (25).

(2) Secondary Phosphate Salt (23)

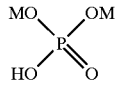

(3) Tertiary Phosphate Salt (24)

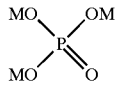

As a specific example of the secondary phosphate salt, sodium dihydrogenphosphate represented by the formula (25) can be mentioned.

(25)

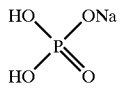

An alkali metal salt or ammonium salt of phosphoric acid compounds other than those recited above can be used. A mixed salt comprising a phosphoric acid compound to which both of an alkali metal end an ammonium group have been bonded can also be used.

As specific examples of an alkali metal salt of the other phosphoric acid salt, there can be mentioned sodium metaphosphate represented by the formula (26):

(26)

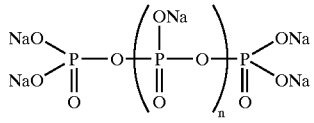

wherein n is usually in the range of 0 to 14, and, for example, when n=4, this compound is sodium hexametaphosphate, and sodium tripolyphosphate represented by the formula (27), (27)

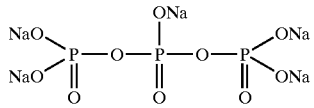

Further, as specific examples of the alkali metal salt and ammonium salt of a phosphoric acid compound, there can be mentioned potassium phosphate, ammonium hydrogenphosphate, potassium pyrophosphate, sodium pyrophosphate, potassium tripolyphosphate and sodium tripolyphosphate.

(iv) Compound Prepared by Introducing Ester Bond Plus Alkali Metal Bond or Ammonium Salt Bond into Phosphoric Acid Compound (1) Dialkylphosphate Salt (28)

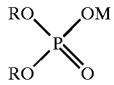

wherein R is an alkyl, phenyl, alkylphenyl group or the above-mentioned hydrophobia group, and M is an alkali metal or ammonium group. These definitions for R and M are the same in the following formulae (29) to (33).

(2) Secondary Monoalkylphosphate Salt (29)

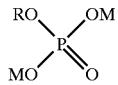

These phosphate salts include, for example, potassium secondary monoalkylphosphate represented by the formula (30):

(30)

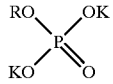

and potassium dialkylphosphate represented by the formula (31):

(31)

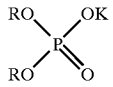

The phosphate salts further include, for example, potassium 2-ethylhexyl pyrophosphate and sodium 2-ethylhexyl pyrophosphate.

(v) Phosphine Compound

The phosphine compound includes, for example, a triphenylphosphine represented by the formula (32):

$$(R)_3P \tag{32}$$

such as triphenylphophine $[(C_8H_8)_3P]$ and triethylphosphine $[(C_2H_8)_3P]$.

(vi) Hexaalkylphosphorus Triamide

The phosphorus-containing compound includes a hexaalkylphosphorus triamide represented by the formula (33):

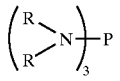

(33)

When R is a methyl group, this compound is hexamethylphosphorus triamide.

Among the above recited phosphorus-containing compounds, phosphoric acid ester surface active agents (usually used as a corrosion preventive), phosphoric acid compounds and alkali metal salts thereof a preferable. An alkali metal dihydrogenphosphate is especially preferable.

Compound (c)

Compound (c) is at least one compound selected from the group consisting of heterocyclic aldehydes, aromatic aldehydes and condensates of these aldehydes, and includes, for example, heterocyclic aldehydes such as furfural, 5-methylfurfural, 5-(hydroxymethyl)furfural, thiophenecarbaldehyde, nicotinic aldehyde and pyridoxal; aromatic aldehydes such as benzaldehyde, tolualdehyde, cuminaldehyde, phenylacetaldehyde, cinamaldehyde, phtalaldehyde, isophthalaldehyde and terephthalaldehyde; and condensates of these aldehydes. Of these, furfural and its condensate are especially preferable.

The ratio of compound (a) to compound (b) is usually in the range of 1:10 to 100:1, preferably 1:5 to 80:1 and more preferably 1:2 to 70:1 by weight. The total amount of compound (a) plus compound (b) is usually in the range of 0.1 to 2,000 ppm, based on the total weight of the hydrocarbon mixture containing a conjugated diene.

The amount of compound (c) is usually in the range of 0.001 to 10% by weight, based on the total weight of the hydrocarbon mixture containing a conjugated diene, The optimum amount of compound (c) varies depending upon the particular highest temperature within a separating and refining apparatus. For example, when the highest temperature is about 150° C., the amount of compound (c) is preferably 0.5 to 5% by weight, and when the highest temperature is about 125° C., the amount of compound (c) is preferably 0.01 to 0.1% by weight.

The procedure of using an anti-galling agent of the present invention is not particularly limited, provided that the anti-gelling agent is used in a state in which it is placed in contact with a conjugated diene or a hydrocarbon mixture containing a conjugated diene.

The anti-gelling agent of the present invention is preferably used in an apparatus for separating a hydrocarbon compound having two carbon atoms such as ethylene from a hydrocarbon mixture containing hydrocarbon compounds having 2 to 9 carbon atoms such as ethylene, propylene, butene, butadiene and isoprene; an apparatus for separating a hydrocarbon compound having three carbon atoms such as propylene from said hydrocarbon mixture; an apparatus for separating a hydrocarbon compound having four carbon atoms such as butadiene or butene from said hydrocarbon mixture; an apparatus for separating a hydrocarbon compound having five carbon atoms such as isoprene from said hydrocarbon mixture; and an apparatus for separating a hydrocarbon compound having nine carbon atoms from said hydrocarbon mixture.

The anti-gelling agent of the present invention may contain, for example, a polymerization inhibitor, a chain transfer agent or an oxygen scavenger, provided that a baneful influence is not exerted upon the object of the present invention.

A method of preventing clogging according to the present invention comprises adding compound (a), compound (b) and compound (c) into an apparatus for separating and refining a hydrocarbon mixture containing a conjugated diene. Compound (a), compound (b) and compound (c) may be added either after they are mixed together, or separately.

The apparatus for separating and refining a hydrocarbon mixture containing a conjugated diene includes, for example, an apparatus for separating a hydrocarbon compound having two carbon atoms from a hydrocarbon mixture containing a conjugated diene; an apparatus for separating a hydrocarbon compound having three carbon atoms from said hydrocarbon mixture an apparatus for separating a hydrocarbon compound having four carbon atoms from said hydrocarbon mixture; an apparatus for separating a hydrocarbon compound having five carbon atoms from said hydrocarbon mixture; and an apparatus for separating a hydrocarbon compound having nine carbon atoms from said hydrocarbon mixture.

The separating apparatus is equipped with a column such as a distillation column, an extractive distillation column or a stripping column; a heat exchanger such as a condenser, a reboiler or a preheater; and a piping, a valve and other elements, The position of an extractive distillation column or a distillation column, at which compound (a), compound (b) and compound (c) are fed into the extractive distillation column or the distillation column is not particularly limited. These compounds (a), (b) and (c) are fed to, for example, a position higher than the raw material feeding stage, an upper side position to an extraction solvent-feeding stage of an extractive distillation column, an inlet or outlet of a condenser equipped on the top part of an extractive distillation column or a distillation column, or an inlet or outlet of a reboiler or a preheater. These compounds (a), (b) and (c) can be fed to the same position or different positions.

As examples of the hydrocarbon mixture containing a conjugated diene to be separated and purified by the anti-gelling agent of the present invention, there can be mentioned a petroleum fraction predominantly comprised of C2 and C3 hydrocarbons such as ethylene and propylene, obtained by cracking of naphtha; a C4 petroleum fraction or a C5 petroleum fraction obtained by separating C2 and C3 hydrocarbons from the petroleum fraction predominantly comprised of C2 and C3 hydrocarbons; and C6 to C9 petroleum fraction obtained by separating C2 to C5 hydrocarbons from the petroleum fraction predominantly comprised of C2 and C3 hydrocarbons. As examples of the conjugated diene contained in the hydrocarbon mixture, isoprene and butadiene can be mentioned.

Figure 2:
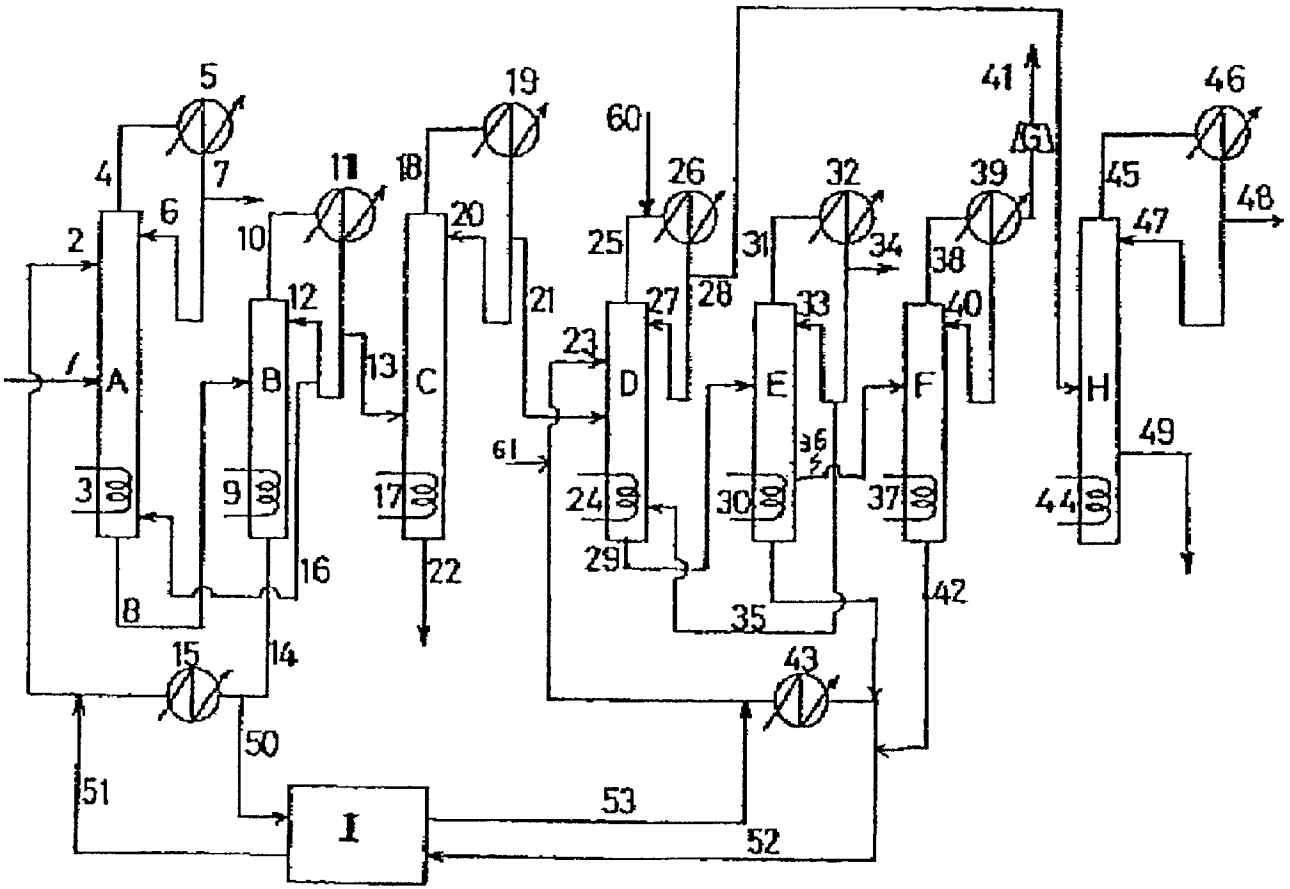
FIG. 2 is a schematic diagram of an apparatus for separating and refining a C5 fraction from a hydrocarbon mixture.
Figure 3:
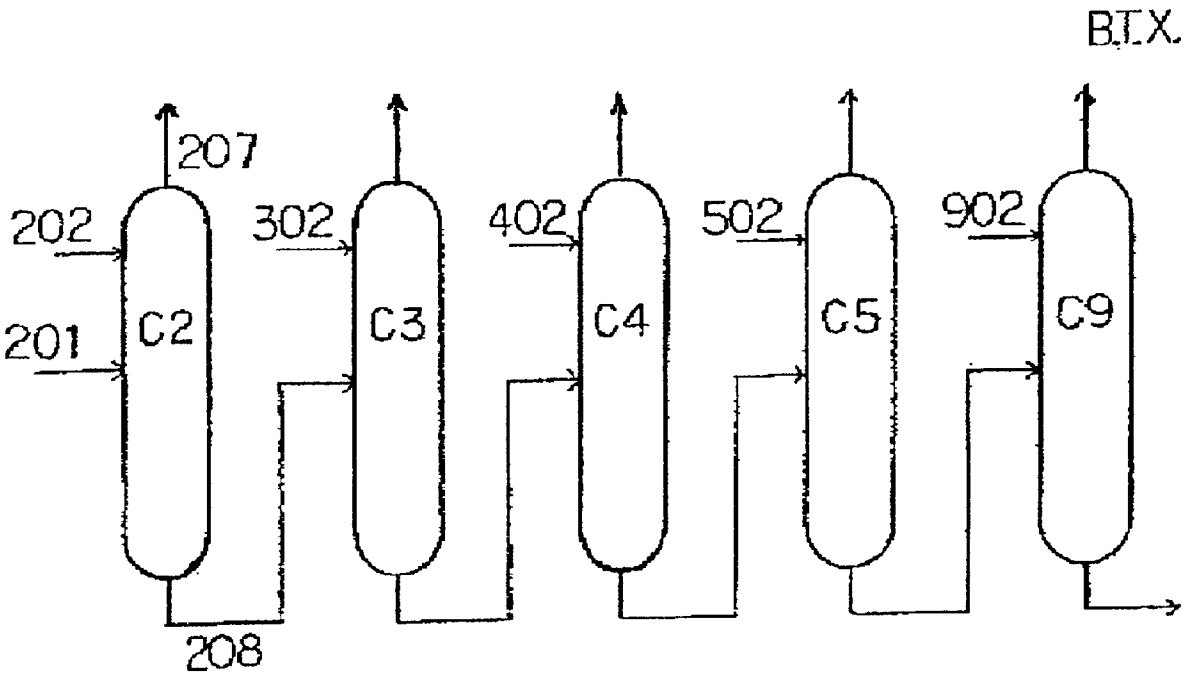
FIG. 3 is a schematic diagram of an apparatus for separating and refining C2 to C9 fractions from a hydrocarbon mixture.

An embodiment of the anti-gelling agent and method of preventing clogging according to the present invention will now be described specifically with reference to the accompanying FIG. 1, FIG. 2 and FIG. 3. FIG. 1, FIG. 2 and FIG. 3 are schematic diagrams illustrating apparatuses for separating-and-refining C4 fraction, C5 fraction and C2 to C9 fraction, respectively, from a hydrocarbon mixture. A column such as a distillation column, an extractive distillation column or a stripping column; a heat exchanger such as a condenser, a raboiler or a preheater; and pipes, valves and other elements are not shown in these figures.

C2 Separation

In FIG. 3, a hydrocarbon mixture containing ethylene, propylene, isoprene and butadiene is fed through a pipeline 201 to an intermediate stage of a C2 separation column. An anti-gelling agent comprised of compounds (a), (b) and (c) is continuously fed through a pipeline 202 to the C2 separation column. The C2 separation column is equipped with a condenser at the top thereof, whereby a part of the vapor is refluxed and the remainder is withdrawn through a pipeline 207 to recover a C2 fraction. Refining of the C2 fraction gives refined ethylene.

C3 Separation

A fraction withdrawn from the bottom 208 is fed to an intermediate stage of a C3 separation column. An anti-galling agent comprised of compounds (a), (b) and (c) is continuously fed the C3 separation column. A C3 fraction is withdrawn from the top of the separation column. Refining of the C3 fraction gives refined propylene.

C4 Separation

A fraction withdrawn from the bottom of the C3 traction column is fed to an intermediate stage of a C4 separation column (debutanizer), An anti-gelling agent of the present invention is continuously fad through a pipeline 402 to the C4 separation column. A C4 fraction withdrawn from the top of C4 separation column is fed to an apparatus for separating and refining the C4 fraction.

In FIG. 1, the C4 fraction is gasified and fed to an intermediate stage of a first extractive distillation column 101. An anti-gelling agent, prepared according to the recipe shown in Example 1, is continuously fed to an intermediate point of pipeline 102 to be thereby mixed with dimethylformamide. The anti-gelling agent-incorporated dimethylformamide is fed through line 102 into the first extractive distillation column 101, and heated by a reboiler 105 equipped at the bottom part of column 101, whereby a first extractive distillation is effected. Gas withdrawn from the top of column 101 is condensed by a condenser 103 and a part thereof is refluxed to the top of column 101. The remainder of gas mainly containing butane and butylene is withdrawn from a pipeline 104. The inner pressure of the first extractive distillation column is usually in the range of 1 to 10 atmospheres and the temperature of the column bottom is usually in the range of 100 to 160° C. An extracted liquid comprised of butadiene and minor amounts of higher acetylene and arene hydrocarbons is withdrawn from the bottom of column. The extracted liquid is fed through a pipeline 106 to the top of a stripping column 107, and is heated by a reboiler 109 at the bottom part of column 107 to be thereby evaporated to effect distillation. The inner pressure of stripping column 107 is usually in the range of 1 to 2 atmosphers and the bottom temperature is a boiling point at the particular pressure.

Butadiene, higher acetylene and arena hydrocarbons are withdrawn from the top of stripping column 107, and liquefied by a cooler 108. A part of the liquefied material is allowed to flow back to the top of column and the remainder is fed through a pipeline 120 to a water-washing column 132.

An extraction solvent is withdrawn from the bottom of stripping column 107, and circulated by a pump 110 through a cooler 111 and a pipeline 102 to the first extraction distillation column 101.

Gas flowing out from the cooler 108 to fed through a compressor 112 and a pipeline 113 to an intermediate stage of a second extractive distillation column 114. The above-mentioned anti-gelling agent-incorporated dimethylformamide is fed through a pipeline 130 to the column 114. Diethylhydroxylamine is introduced through a pipeline 160, provided immediately upstream to an inlet of a condenser 115. The liquid is heated by a reboiler 117 equipped at the bottom part of column whereby second extractive distillation is effected.

The liquid withdrawn from the bottom of second extractive distillation column 114 is fed to an intermediate stage of a recovering column 119. A distillate from the top of recovering column 119 is fed through a pipeline 121 to the compressor 112.

The liquid material withdrawn from the bottom of recovering column 119 is fed through a pump 123 and a pipeline 124 to the top of a stripping column 125. An extraction solvent is recovered from the bottom of stripping column 125. A distillate withdrawn from the top of column is liquefied by a condenser 126 and a part thereof is refluxed to stripping column 125, and the remainder is fed through a pipeline 131 to an intermediate of water-washing column 132.

Water is introduced through a pipeline 133 into water-washing column 132 to refine an extraction solvent so that the extraction solvent is dehydrated to an extent such that it has a water content of 250 ppm in pipelines 102 and 130. The dehydrated extraction solvent flows through a pipeline 138 where extraction solvents from pipelines 129 and 137 are merged into the dehydrated extraction solvent, and the thus-combined extraction solvent is circulated through pipelines 102 and 130 to first and second extractive distillation columns 101 and 114, respectively.

Gas withdrawn from the top of second extractive distillation column flows to a condenser 115 where the gas is condensed and a part thereof is allowed to flow back to the top of column. The remainder thereof is withdrawn from pipe 116 and circulated to the top of first distillation column (not shown in FIG. 1). A distillate discharged from the top of first extractive distillation column 101 is condensed by a condenser and a part thereof is circulated to the column and the remainder is used as fuel for a boiler or burnt by a flare stack.

The material from the bottom of first distillation column in fed to an intermediate stage of second distillation column (not shown). A distillate from the top of second extractive distillation column is condensed by a condenser and a part thereof is allowed to flow back to the column and the remainder is used an high-purity butadiene used, for example, as a raw material for polybutadiene.

C5 Separation

In FIG. 3, a fraction withdrawn from the bottom of C4 separation column is fed to an intermediate stage of a C5 separation column. An anti-gelling agent of the present invention can be continuously incorporated through a pipeline 502 into the C5 separation column. A C5 fraction is withdrawn from the top of C5 separation column. The C5 fraction is fed to a separating-and-refining apparatus as illustrated in FIG. 2.

The C5 fraction is fed to a dimerization reactor for cyclopentane and a fraction withdrawn from the reactor is fed to a pre-distillation column to remove 1,3-pentadiene and dicyclopentadiene. Then, as shown in FIG. 2, a fraction from the distillation column is fed through a pipeline 1 to an intermediate stage of a first extractive distillation column A. An anti-gelling agent of the present invention, prepared according to the recipe shown in Example 1, is added in a midway of a pipeline 2 to be thereby incorporated in dimethylformamide. The anti-gelling agent-incorporated dimethylformaide is fed through pipeline 2 to the first extractive distillation column A. The first extractive distillation column A is equipped with a condenser 5 where a distillate is condensed and a part thereof is refluxed through a pipeline 6 and the remainder is withdrawn through a pipeline 7 as a fraction of pentane and pentene. A fraction from the bottom 8 of column A is fed to an intermediate stage of a first stripping colon B, and an extraction solvent is recovered from the bottom 14 of column B.

A part of the fraction withdrawn from the top of first stripping column B is circled through a pipeline 12 to the first stripping column B, and the remainder of fraction is fed through a pipeline 13 to an intermediate stage of a first distillation column C. From the bottom of column C, 1,3-pentadiene and dicyclopentadiene are discharged.

A fraction (containing about 93% of isoprene) withdrawn from the top of first distillation column C is fed through a pipeline 21 to an intermediate stage of a second extractive distillation column D.

The anti-gelling agent-incorporated dimethylformamide is fed through a pipeline 23 to the second extractive distillation column D. A material taken from the bottom 29 of second extractive distillation column D is fed to an intermediate stage of a recovering column E. A fraction, taken from an intermediate stage positioned lower than the stage to which the material from the bottom 29 of column D is fed, in fed through a pipeline 36 to an intermediate stage of a second stripping column F. An extraction solvent is withdrawn from the bottom of recovering column E and circulated. Acetylene and other fractions are withdrawn through a pipeline 41 from the top of second stripping column. A part of a distillate from the top of recovering column E is condensed by a condenser 32, and a part of condensate is allowed to flow back to recovering column E and the remainder is circulated through a pipeline 35 to second extractive distillation column D.

A distillate (containing about 99% of isoprene) withdrawn from the top of second extractive distillation column is fed through a pipeline 28 to an intermediate stage of a second distillation column H. Butyne-2 can be taken from the top of column H and high-purity isoprene can be taken through from the bottom of column H.

In FIG. 2, "I" shown in the lower part thereof is means for recovering and refining an extraction solvent (dimethylformamide).

C9 Separation

A fraction taken from the bottom of a C5 separation column is fed to an intermediate stage of a C9 separation column, and a anti-gelling agent of the present invention is fed through a pipeline 902 to the C9 separation column. A fraction used for gasoline material is withdrawn from the bottom of C9 separation column, and a fraction mainly containing B.T.X., i.e., benzene, toluene and xylene is withdrawn from the top of column.

The invention will now be described specifically by the following examples and comparative examples, but, the examples by no means limit the scope of the present invention.

EXAMPLE 1

Refined isoprene with a purity of 99.3% was dissolved in dimethylformamide to prepare 20 g of a 15% isoprene solution, The isoprene solution was placed in a pressure-resistant glass vessel, and 180 ppm of diethylhydroxylamine, 18 ppm of sodium dihydrogenphosphate and 2.5% by weight of furfural were added. Then 60 ppm of oxygen was blown therein, and the vessel was closed and allowed to stand in an atmosphere maintained at 150° C. After seven days elapsed, the content was taken from the glass vessel and filtered.

The solid on a filter paper was vacuum-dried at 100° C. for 1 hour. The dried solid is heroin referred to "polymer". The polymer was dipped in toluene for 1 hour and the polymer solution was again filtered. The solid on a filter paper was vacuum-dried at 100° C. for 1 hour. The dried product is herein referred to "gel". The filtrate was vacuum-dried at 100° C. for 1 hour. The dried product is herein referred to "high-boil".

The amounts of the polymer, gel and high-boil were measured, and the ratios thereof to the amount of isoprene charged were determined. The results are shown in Table 1.

EXAMPLES 2 AND 3, COMPARATIVE EXAMPLES 1 to 6

The procedures described in Example 1 were repeated wherein kinds and amounts of compounds (a), (b) and (c) were varied as shown in Table 1 with the other conditions remaining the same. The amounts of the polymer, gel and high-boil were measured, and the ratios thereof to the amount of isoprene charged were determined. The results are shown in Table 1.

TABLE 1

| | Examples | | | Comparative Examples | | | | | |
|---|---|---|---|---|---|---|---|---|---|
| | 1 | 2 | 3 | 1 | 2 | 3 | 4 | 5 | 6 |
| Compound (a) | | | | | | | | | |
| DEHAI (ppm) | 180 | 180 | 180 | — | 200 | — | — | — | — |
| Compound (b) | | | | | | | | | |
| Na-DHP (ppm) | 18 | — | — | — | 20 | — | — | — | — |
| TNP (ppm) | — | 360 | — | — | — | — | 400 | — | — |

TABLE 1-continued

| | Examples | | | Comparative Examples | | | | | |
|---|---|---|---|---|---|---|---|---|---|
| | 1 | 2 | 3 | 1 | 2 | 3 | 4 | 5 | 6 |
| PELEX (ppm) | — | — | 360 | — | — | — | — | 360 | — |
| Compound (c) | | | | | | | | | |
| FF (wt. %) | 2.5 | 2.5 | 2.5 | — | — | — | — | — | 3 |
| Composition of product (wt. %) | | | | | | | | | |
| Polymer | 1.24 | 1.39 | 1.18 | 1.54 | 2.04 | 1.25 | 1.65 | 1.46 | 1.37 |
| High-boil | 0.72 | 0.88 | 0.99 | 0.15 | 0.17 | 0.16 | 0.18 | 0.14 | 0.73 |
| Gel | 0.04 | 0.04 | 0.03 | 0.73 | 1.11 | 0.69 | 0.87 | 0.61 | 0.20 |

Note:
Compound (a) DEHA = diethylhydroxylamine
Compound (b) Na-DHP = sodium dihydrogenphosphate
TNP = tris(nonylphenyl) phosphite
PELEX = PELEX RP, available from Kao Corporation, sesqui-polyoxyethylene-2-ethylhexyl phosphate
Compound (c) FF = furfural

EXAMPLE 4

Refined isoprene with a purity of 99.3% was dissolved in dimethylformamide to prepare 20 g of a 15% isoprene solution. The isoprene solution was placed in a pressure-resistant glass vessel, and 180 ppm of diethylhydroxylamine, 3.6 ppm of sodium dihydrogenphosphate and 180 ppm of furfural were added. Then 180 ppm of oxygen was blown therein, and the vessel was closed and allowed to stand in an atmosphere maintained at 125° C. After three days elapsed, the content was taken from the glass vessel. The amounts of the polymer, gel and high-boil were measured, and the ratios thereof to the amount of isoprene charged were determined. The results are shown in Table 2.

EXAMPLE 5, COMPARATIVE EXAMPLES 7 AND 8

The procedures described in Example 4 were repeated wherein kinds and amounts of compounds (a), (b) end (c) were varied as shown in Table 2 with the other conditions remaining the same. The amounts of the polymer, gel and high-boil were measured, and the ratios thereof to the amount of isoprene charged were determined. The results are shown in Table 2.

TABLE 2

| | | Examples | | Comp. Ex. | |
|---|---|---|---|---|---|
| | | 4 | 5 | 7 | 8 |
| Compound (a) | DEHAI (ppm | 180 | — | — | — |
| | NO* (ppm) | — | 180 | — | 200 |
| Compound (b) | Na-DHP (ppm) | 3.6 | 3.6 | — | — |
| Compound (c) | FF (ppm) | 900 | 500 | 900 | — |
| Composition of product (wt. %) | | | | | |
| Polymer | | 0.53 | 1.31 | 0.92 | 1.44 |
| High-boil | | 0.22 | 0.18 | 0.21 | 0.13 |
| Gel | | 0.01 | 0.04 | 0.35 | 0.97 |

Notes:
Compound (a) DEHA = diethylhydroxylamine
NO* = 4-hydroxy-2,2,6,6-tetramethylpiperidine-1-oxy
Compound (b) Na-DHP = sodium dihydrogenphosphate
Compound (c) FF = furfural

Industrial applicability

By incorporating a small amount of an anti-gelling agent in a hydrocarbon mixture containing a conjugated diene, polymerization of the conjugated diene, especially gelling of polymer can be prevented, and staining in an separation-and-refining apparatus, clogging of pipes, and reduction of heat efficiency in a condenser, a reboiler and others can be avoided. Therefore, operation of the separation-and-refining apparatus can be continued for a long period of time, and the operation cost is reduced.

The method of preventing clogging according to the present invention can be advantageously employed especially in an extractive distillation apparatus and other distillation apparatuses.

What is claimed is:

1. An Anti-gelling agent for a hydrocarbon mixture containing a conjugated diene, which comprises (a) at least one compound selected from the group consisting of compounds having an NO radical in the molecule, and precursor compounds capable or forming an NO radical, (b) a phosphorus-containing compound, and (c) at least one compound selected from the group consisting of heterocyclic aldehydes, aromatic aldehydes and condensates of these aldehydes.

2. An Anti-gelling agent for a hydrocarbon mixture containing a conjugated diene according to claim 1, wherein the conjugated diene is butadiene or isoprene.

3. An Anti-gelling agent for a hydrocarbon mixture containing a conjugated diene according to claim 1, wherein the conjugated diene is isoprene.

4. An Anti-gelling agent for a hydrocarbon mixture containing a conjugated diene according to claim 1, wherein compound (a) is at least one compound selected from the group consisting of steric hindered nitroxyl compounds, steric hindered hydroxylamine compounds and di-lower-alkyl-hydroxylamines.

5. An Anti-gelling agent for a hydrocarbon mixture containing a conjugated diene according to claim 1, wherein compound (b) is a phosphoric acid ester surface active agent, a phosphoric acid compound or an alkali metal salt of a phosphoric acid compound.

6. An Anti-gelling agent for a hydrocarbon mixture containing a conjugated diene according to claim 1, wherein compound (b) is an alkali metal dihydrogenphosphate.

7. An Anti-gelling agent for a hydrocarbon mixture containing a conjugated diene according to claim 1, wherein compound (c) is a heterocyclic aldehyde or a condensate thereof.

8. An Anti-gelling agent for a hydrocarbon mixture containing a conjugated diene according to claim 1, wherein compound (c) is furfural or a condensate thereof.

9. An Anti-gelling agent for a hydrocarbon mixture containing a conjugated diene according to claim 1, wherein the ratio of compound (a) to compound (b) is in the range of 1:10 to 100:1 by weight.

10. A method of preventing clogging in an apparatus of separating and refining a hydrocarbon mixture containing a conjugated diene, which comprises adding into the apparatus (a) at least one compound selected from the group consisting of compounds having an NO radical in the molecule, and precursor compounds capable of forming an NO radical, (b) a phosphorus-containing compound, and (c) at least one compound selected from the group consisting of heterocyclic aldehydes, aromatic aldehydes and condensates of these aldehydes.

11. A method of preventing clogging according to claim 10, wherein the conjugated diene is butadiene or isoprene.

12. A method of preventing clogging according to claim 10, wherein the conjugated diene is isoprene.

13. A method of preventing clogging according to claim 10, wherein said separating-and-refining apparatus is used for separating a hydrocarbon compound having two carbon atoms, a hydrocarbon compound having three carbon atoms, a hydrocarbon compound having four carbon atoms, a hydrocarbon compound having five carbon atoms or a hydrocarbon compound having nine carbon atoms, from the hydrocarbon mixture containing a conjugated diene.

14. A method of preventing clogging according to claim 10, wherein said separating-and-refining apparatus is used for separating a hydrocarbon compound having four carbon atoms or a hydrocarbon compound having five carbon atoms from the hydrocarbon mixture containing a conjugated diene.

15. A method of preventing clogging according to claim 10, wherein said separating-and-refining apparatus is used for separating butadiene or isoprene from the hydrocarbon mixture containing a conjugated diene.

16. A method of preventing clogging according to claim 10, wherein said separating-and-refining apparatus is used for separating a hydrocarbon compound having five carbon atoms from the hydrocarbon mixture containing a conjugated diene.

17. A method of preventing clogging according to claim 10, wherein said separating-and-refining apparatus is used for separating isoprene from the hydrocarbon mixture containing a conjugated diene.

18. A method of preventing clogging according to claim 14, wherein said separating-and-refining apparatus is an extractive distillation apparatus for separating the respective hydrocarbon compound.

19. A method of preventing clogging according to claim 14, wherein said separating-and refining apparatus is an extractive distillation apparatus for separating the respective hydrocarbon compound by using dimethylformamide as an extraction medium.

20. A method of preventing clogging according to claim 12, wherein the ratio of compound (a) to compound (b) is in the range of 1:10 to 100:1 by weight; and the total amount of compound (a) and compound (b) is in the range of 0.1 to 2,000 ppm and the amount of compound (c) is in the range of 0.001 to 10% by weight, based on the total weight of the hydrocarbon mixture containing a conjugated diene.

21. A method of separating a hydrocarbon from a hydrocarbon mixture containing a conjugated diene by distillation, characterized in that the distillation is carried out in the presence of an anti-gelling agent comprising (a) at least one compound selected from the group consisting of compounds having an NO radical in the molecule, and precursor compounds capable of forming an NO radical, (b) a phosphorus-containing compound.

* * * * *